US006540435B1

(12) United States Patent
Lizarraga

(10) Patent No.: US 6,540,435 B1
(45) Date of Patent: Apr. 1, 2003

(54) CURB MOLD AND EXTRUDING SYSTEM

(76) Inventor: Rodolfo Lizarraga, 1450 Melrose Ave., Unit 102, Chula Vista, CA (US) 91911

( * ) Notice: Subject to any disclaimer, the term of this patent is extended or adjusted under 35 U.S.C. 154(b) by 0 days.

(21) Appl. No.: 09/716,030

(22) Filed: Nov. 16, 2000

(51) Int. Cl.[7] ..... E01C 11/22

(52) U.S. Cl. ..... 404/98; 404/96; 425/63; 425/64; 249/2; 249/8

(58) Field of Search ..... 249/2, 8, 208; 404/98, 96, 105; 425/63, 64

(56) References Cited

U.S. PATENT DOCUMENTS 3,600,773 A * 8/1971 Davis et al. ..... 249/2
4,084,928 A * 4/1978 Petersik ..... 404/100
4,152,382 A * 5/1979 Catenacci ..... 264/33
4,298,293 A * 11/1981 Baucom ..... 404/98
4,384,806 A * 5/1983 Taylor, Jr. ..... 404/105
4,391,549 A * 7/1983 Murray ..... 404/87
4,566,823 A * 1/1986 May ..... 404/98
5,018,955 A * 5/1991 Parrish et al. ..... 249/2
5,062,737 A * 11/1991 Samuels ..... 404/98
6,293,728 B1 * 9/2001 Eggleton et al. ..... 404/100

* cited by examiner

*Primary Examiner*—Gary S. Hartmann
(74) *Attorney, Agent, or Firm*—Donn K. Harms

(57) ABSTRACT

A molding device for placement of formed cementitious material such as concrete on a mounting surface. The device is used in combination with a supply of pressurized cementitious material communicated through a hose from a conventional cement pump or the like. It features a mold unit having an a compression chamber at a first end communicating with an extrusion chamber at a second end. Cement material is forced into the compression chambers from the cement pump and extruded from the exit orifice of the extrusion chamber. The device is propelled forward by the pressure from the injected cement against the front of the device and away from the formed material means control any upward travel of said mold unit caused by said internal pressure against said top wall. Weights may be added to the top of the device to limit upward travel and a steering mechanism may be added to the front of the device to steer it on a defined course. By making the extrusion chamber detachable from the compression chamber the device is reconfigurable to extrude different shaped concrete curbs.

20 Claims, 4 Drawing Sheets

CURB MOLD AND EXTRUDING SYSTEM

FIELD OF THE INVENTION

This invention relates to a curb mold and extruding system used in forming concrete, cement or other building materials into curbs, gutters, barrier walls, sidewalks, and the like quick and easily on construction projects.

BACKGROUND OF THE INVENTION

The present invention relates to a mold used for concrete formation. More particularly, it relates to an extrusion molding device, which when connected to a conventional concrete pump, or other like apparatus, extrudes concrete, cement or other similar building materials into a multitude of shapes to be used in the construction field as curbs, gutters, barrier walls, sidewalks, and the like. In the past, it has been necessary to use hand placed, wood, or metal forms to be assembled, taken apart, and reassembled through out the project. This process is labor and time intensive, requiring the material to harden before the molds may be removed. In the area of sidewalks, the concrete must be roughly smoothed between the forms, this is called screeding, then it is float finished with either a bull float or hand float. The edges must be finished with an edging tool, then, after the material has reached a desired degree of hardness, it is hand or machine finished with trowels to a smooth surface and given any number of textured surfaces, the most common being a broom finish.

In the act of constructing extended concrete structures, a control or expansion joint must be installed periodically by either scribing or inserting a fiber or metal insert. When concrete is placed between forms, varying degrees of water may be added to allow ease of spreading. This is usually left to the digression of the finishers, sometimes to excess, which they call self-leveling. Too much water in concrete decreases the hardness or pounds per square inch (PSI) hardness rating of the material, it also allows a separation of materials with the rock and reinforcing bar going to the bottom.

When concrete is dispensed through a pump, the water content may be strictly controlled producing a harder and more consistent grade of material, with written verification available, if required. A broad range in size and capabilities of portable concrete pumping services are available in most cities, where the pump is towed behind or part of a separate vehicle, and material is dispensed from a supply truck into the pump hopper and pumped through a hose to the desired location. Reinforcement of the extruded material may be accomplished through the introduction of various fibrous materials, such as polypropylene fiber, called fiber mesh. This material strengthens the structure mainly against the small hairline cracks and spalling caused by freezing, but does not help with the large cracks caused by heaving of the ground in the areas with alluvial soils, or lack of adequate compaction of the underlying soils. Nothing can replace the structural strength of a continuous reinforcing bar added to the building material.

Many types of curb forming machines have been developed, from large slip-form machines used in freeway construction, to the smaller curb forming and extruding machines used in general construction. In most of these machines, the construction material must be manually placed into the hopper, on the device where it is either manually or mechanically transported by pressure into the extrusion cavity. Such devices require an engine or pump onboard the formation machine itself and render it heavy, requiring a power source, and otherwise inconvenient. The weight and the adhesion of the material to the surface along with the pressure pushing the material into the extrusion cavity propels the device in a forward direction, although being difficult to go up or down inclined surfaces, because of the excessive weight of the apparatus. In general, these machines use an attached motor to supply the driving force required, making them very cumbersome even in the lightest models. The act of adding reinforcing bar is made difficult, due to the required location of the auger or plunger pushing the material into the extrusion cavity. Some manufactures claim reinforcing bar is not necessary with the introduction of fiber mesh, which is not correct.

Cleaning concrete equipment and keeping it clean is a major problem in the industry. When concrete is left on any tools or equipment for a period of time it is extremely hard to remove, thus a piece of equipment with many moving internal parts is very hard to keep clean.

Transportation of the material to the extruding equipment from the mixer or truck is another major problem with the conventional curb machines where the hopper must be loaded by hand and the material transported by wheelbarrow. These processes being difficult with small extrusions where minimal amounts of material are required are impossible with larger cross sectional areas, as in side walks and road dividers.

U.S. Pat. No. 4,566,823 by George N. May describes a manually operable curb extrusion device for extruding curb, barrier, or the like from concrete, cement, or some other moldable building material. The building material is manually placed in a receiving hopper and falls into a compacting chamber where a power driven reciprocating compacting member compacts the material into the extrusion mold where it is shaped before extrusion. There is no means to insert reinforcing bar into the cavity because the inventor states that with the use of fiber mesh it is not required; although, on some Municipal and Federal contracts reinforcing bar is required. This device would not be capable of any large cross sectional concrete extrusions.

U.S. Pat. No. 5,527,129 by Paul G. McKinnon discloses a manually operable and steerable curb extrusion device for extruding curb, barrier, wall, gutter, or the like from concrete, cement, or some other moldable building material. The curb extrusion device has a hopper into which building materials are placed to fall into a reciprocating orbital compaction member which compacts, kneads, and forces the building materials through an open-ended extrusion mold where it is shaped before extrusion. This is another motorized concrete compressing device supplied with a hand fed hopper. Here again not capable of large cross sectional concrete extrusions and labor intensive.

U.S. Pat. No. 5,354,189 by Paul M. McKinnon additionally discloses a manually operable and steerable curb extrusion device for extruding curb, barrier, wall, gutter, or the like from concrete, cement, or some other moldable building material. The curb extrusion device has a segmented vibrating hopper into which building materials are placed to fall onto two tapered vibrating augers that compact and force the building material through an extrusion mold where it is shaped before molding. This is another motorized curb extruding device. Though larger with a vibratory action and two steering wheels, it requires a wider operating footprint to be cleared prior to the operation and also relies on the hopper being manually filled.

U.S. Pat. No. 5,018,955 by Robert W. Parrish teaches of an apparatus for shaping and extruding concrete or other moldable material as a decorative curbing. Moldable material is placed in a hopper and flows into an auger which compresses, mixes, and extrudes the material through a shaped, non-flanged mold into the desired curb bed. A fueled engine or electric motor drives a hydraulic pump to pressurize hydraulic fluid. The pressurized fluid drives a hydraulic motor which turns the auger. This device, having greater capacity and a more controlled power source, would require an even wider footprint to be cleared prior to operation and still requires the hopper to be hand fed. U.S. Pat. No. 4,310,293 by Richard C. Eggleton describes a machine for compacting and molding concrete mix or other plastic materials. This machine incorporates a powered ram plate which reciprocally moves from a first position adjacent to the body structure to a second position wholly within the molding member, picking up the material from the base of the hopper. This machine is supported on three or four or sometimes more than four wheels. This is another motorized, hopper-fed, wide curb machine.

U.S. Pat. No. 3,733,141 William T. James teaches of a machine for forming curbing consisting of a manually operable, steerable device which compacts and shapes asphaltic concrete or portland cement mixes having no slump characteristics into uniform curbing. Though manually operated, this device utilizes the same principal of a plunger pushing material through the base of a manually filled hopper into a molding chamber, driving the device forward. This device would definitely not be capable of extruding any appreciable size or length of curbing and demands a great deal of exertion by the operator as well as the individual filling the hopper.

U.S. Pat. No. 3,585,911 by John Vlasic describes a curbing apparatus consisting of a manually operable wheeled vehicle for forming curb mix asphalt into a uniform curb. The vehicle carries a curb forming shoe with a hopper thereabove and a manually controlled shutter and plunger. This manual apparatus is not capable of extruding appreciable size or lengths of curbing.

U.S. Pat. No. 3,566,760 by Napoleon G. Lafleur et al. discloses a paving machine for laying asphalt, preferably in a double-curbed channel form. This device in no way will operate in the manner to extrude any quantity of concrete curbing.

All of these hopper-fed machines could be supplied by a conventional concrete pump, but would in no way be able to handle the capacity of building material available through this means.

There is a pressing need for a simple curb mold and extruding system which does not require a motor or storage hopper to be manually filled, which does not require a wide area to be cleared to operate in and can lay down an unlimited amount of curbing with reinforcing bar, in a great number of cross sectional shapes, from freeway barriers to small curb forms, that can lay down a curb as straight as a laser beam as well as curves of varying diameters, and that can go up as well as down inclined slopes with ease. There is a need for a new and unique system that requires fewer laborers with much less exertion required and is easily cleaned upon completion of the project.

These and many other ramifications in the field of concrete and other like building materials used on construction projects will be greatly simplified with the incorporation of this new and unique invention.

SUMMARY OF THE INVENTION

The present invention accomplishes its desired objects by providing a system of injecting the concrete, cement, or any other similar building material, by a remote pump, into a unique mold which extrudes the desired curb, gutter, barrier wall or sidewalk while moving under control of an operator. A remote trailer mount or vehicle mounted pump is conventionally located adjacent to the building material supply truck. The driver of the material supply truck keeps the hopper of the pump full, while the pump is controlled by an operator with a wireless remote standing near the end of the distribution hose, with additional lengths of hose to be added during the process. The hoses on these contract pump units, being in segments, commonly exceed one hundred feet in length. Material supply trucks are changed without interrupting the flow, due to the large capacity of the pump's hopper. The hose and pump can have a wide range of sizes and capabilities depending upon the required output, and can deliver an unlimited amount of material as long as desired. This factor can make possible a wide range in sizes of molds, controlled only by the capabilities of the pump available.

The operator will stand in front of the mold that is attached to the end of the pump hose, holding the handle to guide it in the desired direction with one of a number of different guidance means, and very little effort required. A laborer would conventionally stand in close proximity to the mold holding the hose, generally over his shoulder, allowing the mold to fill and traverse forward propelled by the pressure of the material in the mold cavity. Generally, several laborers are required to watch and maintain the hose to insure a smooth and continuous flow of material and that the hose does not kink.

Weights are added to the top of the mold to keep it from lifting too much due to the pressure of the pump, although through the process the mold will float approximately one inch above the surface. The height of the leading end of the mold may be adjusted by a number of different elevator wheel means determined by the character of the mold. The length of the back of the mold or extrusion cavity determines the shape and smoothness of the extrusion, a longer length giving a smoother finish, though not capable of making as sharp a radius. Sections may be added to the mold to increase the length as desired.

Alignment brackets mounted to the side of the mold retain a string line that the operator will follow to maintain a straight line. An optional and advanced method for alignment and elevation correction would be a laser line to a computer controlled, motorized gearbox mounted on the elevator post of the guide wheel. This box could make adjustments in elevation through a system of gears and also indicate alignment corrections required by a beeping sound. Another adaptation of the laser system would have the laser activated box beep, or lights blink, both for up and down and side to side adjustments required, with the operator making them manually.

Reinforcing bar is fed through one or more reinforcing bar insertion tubes in the leading end of the mold by a laborer. These insertion tubes also provide a means to vent trapped air from the inside of the mold cavity, but are too small to allow any appreciable amount of material to go through. An optional tubular member on top of the mold allows for the insertion of the stinger or head end of a hand-held vibrator, commonly used in the concrete industry, to be attached, thus increasing the compaction of the material. Using this system, the material can have less water incorporated into the mix, producing a higher PSI, or pounds per square inch hardness rating. In some configurations, the mold will be segmented, the lead end being the compression chamber, the back being the extrusion cavity. The extrusion cavity may consist of several segments extending any given length with some incorporating surface treatment devices such as a control joint cutter or an edge tool. This also allows that one compression chamber will fit a variety of different styles of extrusion chambers.

Preparation for the process is greatly simplified by the fact that only a narrow strip needs to be set to grade before initiating the process, sometimes as little as 12 inches, depending upon the width of the mold. If a straight section is desired, a string or laser can be set up, adjacent to the graded strip, to maintain straightness. Otherwise, a predetermined chalk or paint line on the surface would be all that is required for the operator to follow. Levels mounted on top of the mold can give parallel and transverse level indications on level surfaces only. A small form must be placed at the beginning of the extrusion to place the mold against to start the process, with small curb molds it may only require a cinder block to start.

BRIEF DESCRIPTION OF DRAWING FIGURES

FIG. 1 is a perspective view of the simplest of the preferred embodiments of the mold device, consisting of a single piece mold unit, bearing two weight posts, a vibratory actuator mount, a two wheel elevator system with a single orifice pump hose elbow and single reinforcing bar insertion tube. This unit would provide a major improvement in the time and labor required to form curbing and similar concrete structures during construction.

DETAILED DESCRIPTION OF PREFERRED EMBODIMENTS

Figure 1:
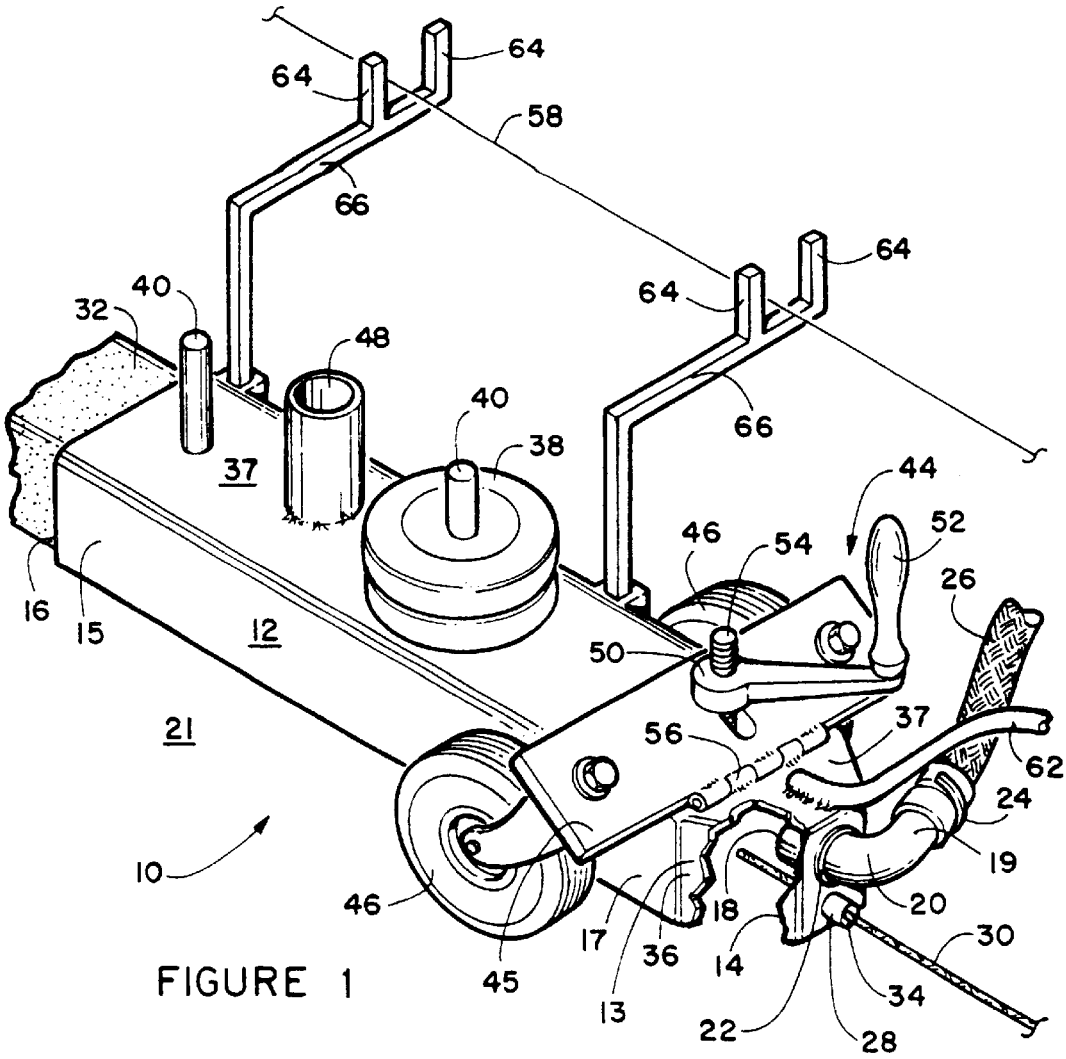

Referring now to FIG. 1 showing a perspective view of the simplest version of a preferred embodiment of the device 10, features a unitary mold unit 12 consisting of a frontal compression chamber 14 and a lateral extrusion chamber 16. The pressurized building material, as in concrete, cement or other material with similar characteristics, is injected under pressure from a pressurizing means such as a conventional concrete pump (not shown) used in combination herewith, into the compression chamber 14. Concrete 32 from the pump means is communicated to the intake pipe which in this embodiment is shown as intake pipe 20 which in this embodiment is in the form of a curved or elbow, by attaching the conventional high pressure hose 26 to the distal end of intake pipe 20 in the conventional fashion using a sealed means of attachment of the high pressure hose 26 to the intake pipe 20 and a conventional cooperatively engageable fitting on both. Concrete under pressure is thus transmitted from a reservoir source such as a truck, through the means for pressurizing the concrete such as a conventional concrete pump, and under pressure through the hose 26. Exiting the hose 26 at the sealed connection of the hose 26 and the intake pipe 20 the concrete is thus forced under pressure through the internal conduit of the intake pipe 20 to the pipe exit orifice 18 situated on the opposite end of the intake pipe 20 from the hose 26. The intake pipe 20 is of course in sealed engagement through the side wall of the mold unit 12. The concrete thus enters the compression chamber 14 end of the mold unit 12 under pressure.

As depicted in FIG. 1, a means for sealed cooperative engagement of the exit end of the hose 26 and the entry end 19 of the intake pipe 20 is required to avoid leaking of the pressurized concrete and there are many conventional hose and pipe cooperative engagements that may be used so long as the engagement provides an adequate seal for the pressure of the concrete flowing therethrough. Optionally, a swivel connection 22 of the intake pipe 20 through the sidewall of the mold unit 12 at the compression chamber 14 end, can provide more versatility in the direction from which the hose 26 may feed. However, a fixed and sealed engagement of the intake pipe 20 through the wall of the mold unit 12 will also provide sealed communication of the pressurized concrete to the compression chamber 14 end of the mold unit. In a simplified version the intake pipe 20 could be replaced with a straight section of pump hose connecting pipe welded to a sealed engagement through the wall of the mold unit to communicate concrete to the compression chamber 14, however in the current best mode of the device 10 the intake pipe 20 would be of a curved formation.

As depicted, the pump hose coupling forming a means for sealed engagement with the intake pipe 20, is accomplished using a clamp 24 affixed to the concrete exiting end of the pump hose 26 which is slid over the distal or entry end 19 of the intake pipe 20 in a conventional tubing over pipe engagement. A sealed engagement is achieved by compressing the clamp 24 around the pump hose 26 to compress the interior wall surface of the pump hose 26 on the exterior surface of the pump elbow 20 to achieve a sealed engagement that will allow highly pressurized concrete to flow through the pump hose 26, through the hollow internal passage of the intake pipe 20 to an exit under pressure at the exit orifice 18, inside of the extrusion chamber 16. Using a standard hose attachment provides exceptional utility as multiple lengths of conventional pump hose 26 may be attached to each other to traverse the required distance to the pump. This is especially handy on construction sites with long dirt areas between the concrete curb being formed and the cement or concrete being transported by means of a contracted pumping unit with a hopper filled by a material supply truck. Such use of long hoses also allows for connection to conventional concrete pumps with their own source of power thus alleviating the need for on board power or pressure at the device 10.

Adjacent to the pump hose intake pipe 20 is an optional but preferred reinforcing bar insertion tube 28 communicating through the sidewall of the device 10 whereby reinforcing bar 30 may be fed through the side wall of the device 10 and placed into the extruded finished product 32. This reinforcing bar insertion tube 28 has a central conduit that not only provides passage of the reinforcing bar into the device 10, it also provides means to vent air from the compression chamber 16 through an orifice 34 communicating through the sidewall of the device 10 to the atmosphere outside. This allows entrapped air in the compression chamber 14 to escape during use. Of course, the reinforcing bar insertion tube 28 might be omitted from the device 10 should such not be needed and in such cases a similar means to vent trapped air would be used in the form of a communicating orifice from the compression chamber 14 through the sidewall of the device 10 to vent air from the mix.

Concrete or other fluid cement style material pumped into the device 10 will conventionally contain some air and gasses trapped in the mix. By placing the insertion tube 28 at the rear end or compression chamber end 14 of the device 10, a means to vent gas or air is provided and most of the trapped air is released from the mix in the compression chamber and forced to the rear of the device 10 by the compressing concrete or cement being compressed toward the extrusion end 15 of the device 10. The air is thus purged from the final mix and a much better compaction of concrete or cement or similar material is achieved.

In the current best mode, venting of trapped gas is enhanced by the inward angular side walls 36 and top wall 37 of the device as depicted where they both angle inward toward the intake end 13 of the device adjacent to and part of the compression chamber 14. The narrowing of the intake end 12 creates a unique shape whereby the material is forced into the wider extrusion chamber 16 end of the device 10 and a minimum amount of air is entrapped since it is focused toward the narrowed intake end 13 of the compression chamber where it exits the communicating orifice 34. Of course, other shapes may be used to narrow the compression chamber 14 at the intake end 13 and such are anticipated. However, the current best mode features the inwardly angled sidewalls 36 and top wall 37.

As the moist cement material is forced into the extrusion chamber 16 over a dry surface such as dirt, the continuing flow of pressurized cement or concrete into the device 10 naturally creates an opposing or opposite force that is translated into an upward and longitudinal pressure against the sidewalls at the intake end 13 and the top wall 37. This force may be captured to the advantage of the performance of the device 10 in that it tends to move the device 10 away from the extruded curb 32 and slightly upward from the material being formed in the extrusion chamber 16 end of the device. Using a means to control the upward travel of the device away from the ground 21 or other graded surface 42 the bottom edge of the sidewalls 36 are lifted from the ground 21 at an optimum level. Control and adjustment over the lift on the device 10 imparted by the force of the pressurized mix being injected is achieved by placing one or a plurality of weights 38 over the weight post 40, the mold device 10. The user can thus adjust the amount of weight imparted to the device 10 to control the upward force imparted by the pressurized mix and thereby adjust the height of the device from the ground 21 during use.

A means for control of the speed of the device away from the curb 32 being laid is also provided by adjustment of the weights 38 concurrently with adjustment of the input pressure provided by the concrete pump used in combination herewith. In the current best mode for laying curbs and the like, the user would place sufficient weights 38 on the device 10 to maintain it approximately one inch off the ground 21 or other graded surface 42, and compact the mix inside the extrusion chamber during use. The resulting pressure of the pumped concrete or cement mix into the device and against the extruded curb 32 is translated first into compression of the extruded mix into a tightly compacted curb 32 and then into movement of the mold assembly 10 away from the extruded curb 32. The result yields a means of propulsion for the mold assembly 10 away from the extruded material during use. It also improves compaction of the mix that is highly desirable as well as minimizing the effort required by the user to move the device 10 while in use since it is continually forced away from the curb being extruded. Additionally, the rise imparted by the force of the pressurized mix against the top wall may be aided by provision to the extrusion chamber 16 intake end 13 of the device 10 of an elevating mechanism 44. The elevating means is provided by an adjustable mechanism to elevate the intake end 13 during use which helps level the device 10 during use as the exit end 17 tends to rise more from the internal pressure. Provision of the elevating means also provides a means to level the device 10 during use when weights 38 are placed on the device 10 and the exit end rises from pressure. The elevation means having an adjustable mechanism and wheels 46 also make the unit easily moved forward or away from the curb 32 being formed on wheels 46.

Optional material surfacing techniques may also be incorporated in the device 10 if desired. Once such option would be the incorporation of a tubular attachment member 48 for the insertion of the conventional stinger or vibratory end of a conventional portable back-pack vibrator commonly used to compress building materials. This process compresses the material even further and brings moisture to the surface between the mold and the material, aides in producing a smooth surface with lower water content, and provides a product with a higher PSI, pounds per square inch hardness rating.

As shown in FIG. 1, a means to elevate the intake end 13 of the device is provided by a two wheel elevating mechanism 44, where an elevator nut 50 with crank handle and arm 52 are turned around threaded shaft 54 to maintain the required height adjustment of the intake end 13 above the ground 21 or a graded surface 42 to run substantially level with the extrusion end 15. Adjustment is provided by compressing and lowering the hinge plate 45 attached to the top of the device using hinge 56. The adjustment mechanism 44 thus maintains the height of the intake end 13 of the device 10 on two attached pivoting wheels 46 which provide a rolling mechanism to aid in rearward travel of the device 10 during use. The pivoting wheels 46 also provide a means to steer the device 10 and thus allow for straightness corrections or curved extrusions.

The device also in the best embodiment features a means to guide the device 10 along a predetermined path designated by paint or chalk on the ground 21, a string line 58 or laser line 60, by holding handle 62. Of course the device 10 would function without it as the user could perhaps draw a line on the ground 21 and keep the sidewall 36 of the device running parallel to such a marked line, however in the current best mode of the device the function is significantly enhanced by inclusion of a means to guide the device on a predetermined path. A means to steer the device 10 is also provided by the wheels 46 which may be pivotally mounted to the hinge plate 45 or similar mount with steering therein accomplished by pulling on handle arm 52 in the direction desired to maintain the correct travel of the device 10.

One embodiment of a means to guide the device along a predetermined path is depicted in Figure One showing a conventional string line 58 having been installed the length of the straight section of desired extruded product 32. By maintaining the string line 58 between the pair of upright arms 64 on two attached alignment brackets 66, as the mold device 10 progresses in a forward direction away from the extruded curb 32 along the graded path, a straight path may be maintained.

Figure 2:
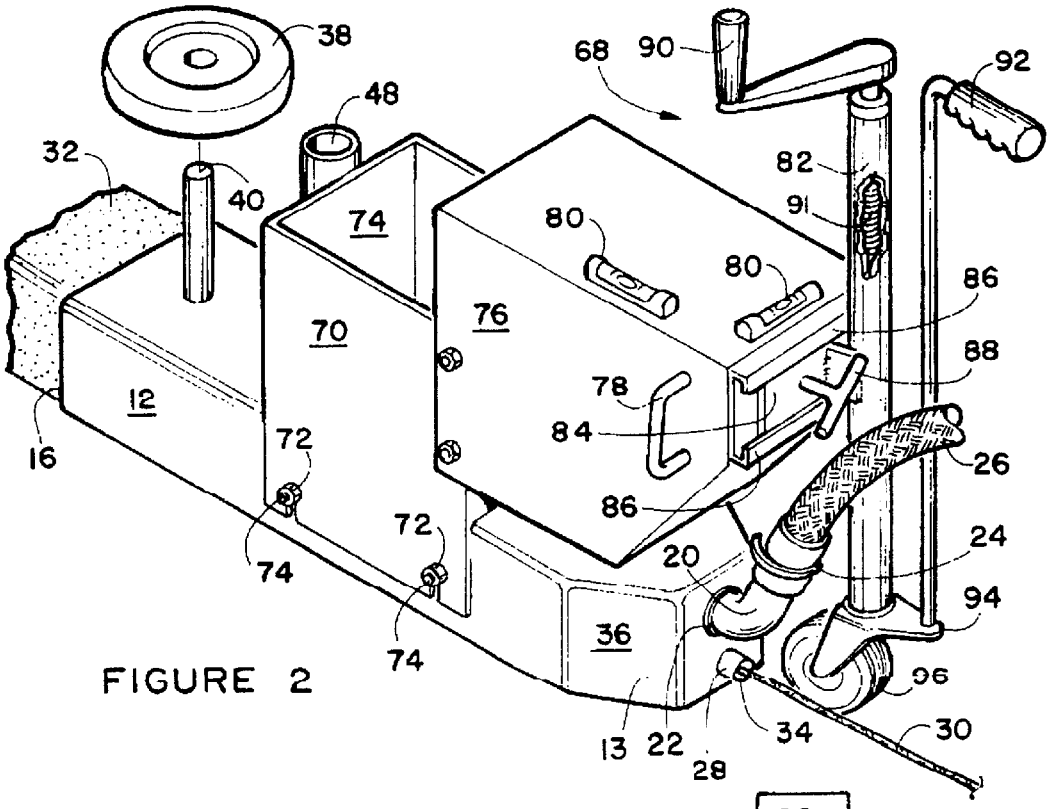
FIG. 2 is a perspective view of a similar preferred single piece mold unit incorporating a mounting and elevator support box, with a manual hand crank elevator and a single wheel steering capability.

FIG. 2 is a perspective view of another preferred embodiment of the device featuring mold unit 12 so described in FIG. 1 with the incorporation of an alternate, single wheel 96 height adjustment means 68. This height adjustment means consists of a mounting and storage box 70 attached to the mold unit 12 by nuts 72 and studs 74 welded to the storage container 74. Elevator support box 76 is attached to the mounting and storage box 70 with a similar nut 72, and stud 74 means. Handle 78 is attached to one or both sides of support box 76 to help in handling. Also included are longitudinal and transverse spirit levels 80 located on the top of elevator support box 76 establish the level of the mold unit 12 when it is used on a level surface. Of course the levels might also be mounted to the device of FIG. 1 for more input on the device 10 to the user. Elevation post 82 is adjustably attached to support box 76 by the means of the sliding plate 84, which translates within angles 86, and is locked in position by tightening "T" handle 88. Elevating the front of mold unit 12 is accomplished by rotating crank handle 90 in a conventional fashion to turn conventional trailer style jack which has an internal gearing mechanism 91 which elongates the elevations post to raise the front of the mold unit 12. The means for steering of the unit is accomplished by adjusting the control handle 92 that is attached to the pivoting wheel mount 94, the weight bearing down on the wheel 96.

Figure 3:
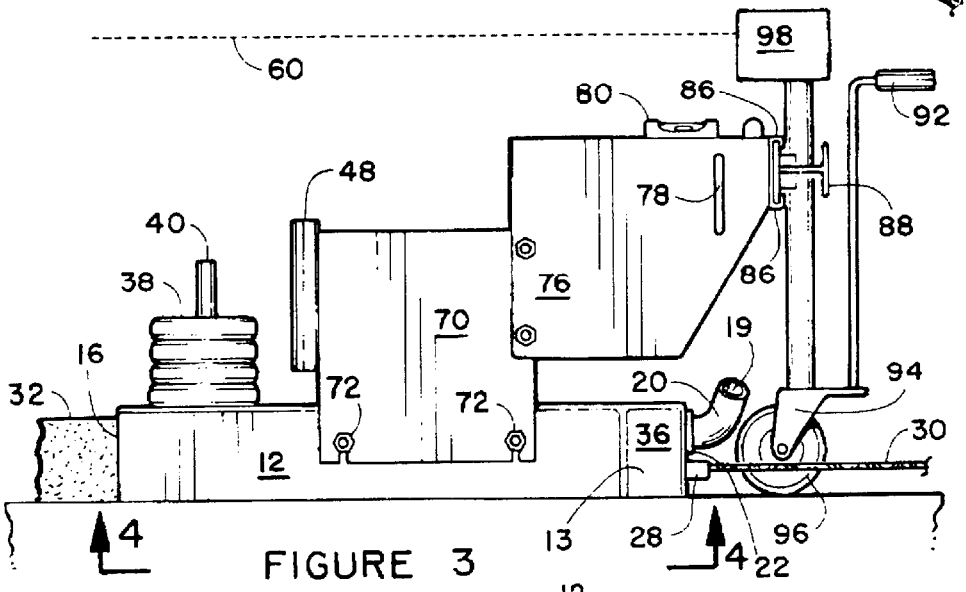
FIG. 3 is a side view of FIG. 2 incorporating a laser beam control and elevator system.

FIG. 3 is a side view of the apparatus as shown in FIG. 2 with the means to guide the device along a predetermined path provided by unique variation of a laser guidance and height adjustment unit 98. With this laser system, laser line 60 is established parallel to the path of the desired extrusion, and in line with the laser unit 98. With any fluctuation from the preset position of the laser, the laser unit 98, through a series of gears, will either raise or lower the front of the mold using the elevator post 82. Adjustments required in the lateral position of the mode will be indicated by a series of beeps, with the corrections made by the operator. Another adaptation of the laser system would have the unit beeping or lights blinking, for both the lateral adjustment required and the height adjustment required, with the operator making both corrections manually.

Figure 4:
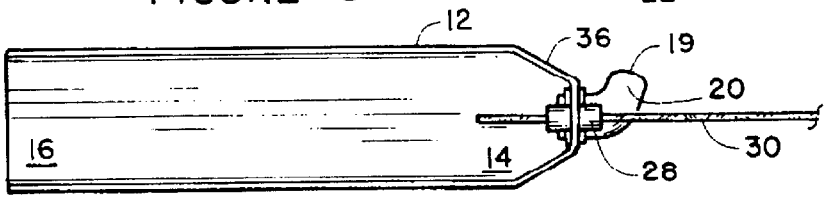
FIG. 4 is a bottom view of the preferred embodiment of the mold unit displaying the entry of the pump hose elbow and the reinforcing bar insertion tube.

FIG. 4 is a bottom view of the unitary version of mold unit 12 displaying the clean and unobstructed cavity of the extrusion chamber 16 and the tapered area of the compression chamber 14 with no comer areas to entrap air. Also displayed in this view is the straight entrance of the reinforcing bar into the extrusion chamber through the insertion tube 28 which communicates through the sidewall of the device 10.

Figure 5:
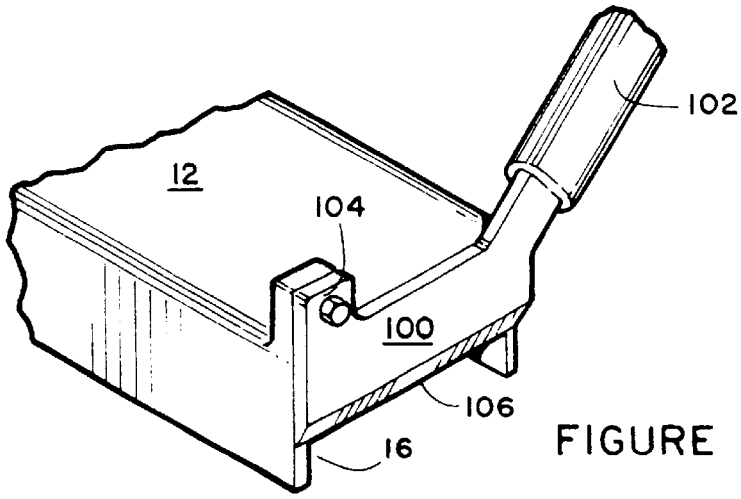
FIG. 5 is a perspective view of an optional control joint or cutoff device attached to the end of any section of the molding system.

FIG. 5 depicts a means to block the exit of material from the device 10 in the form of a scissors type apparatus 100 that is optionally added to the exit or extrusion end 15 of the extrusion chamber 16 to confine the building material therein during start-up, and to locate and insert control and expansion joints during the operation. The function of the scissors is to be held in the upright position until needed, then, by rotating downward with handle 102, on pivot point 104 the blade 106 closes the extrusion cavity 16 confining the building material or locating the expansion joint in the crevasse formed in the extruded curb 32.

Figure 6:
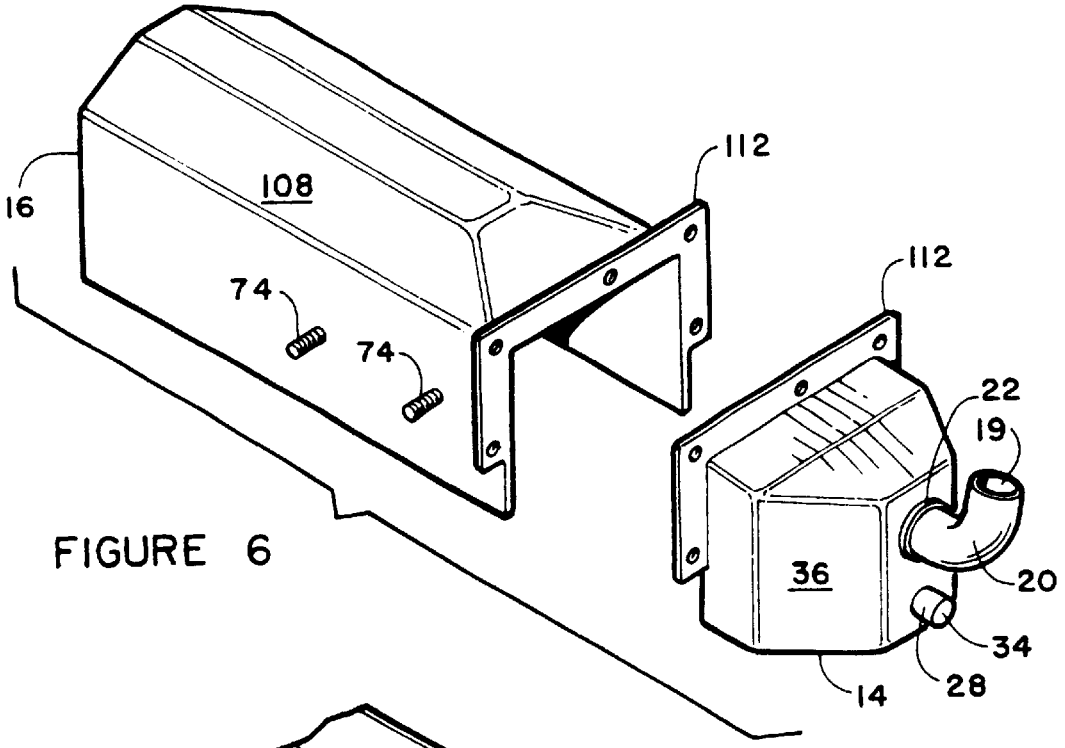
FIG. 6 is a perspective view of another embodiment of the device featuring a plurality of forms that can be attached to the unit to form different shapes.
Figure 7:
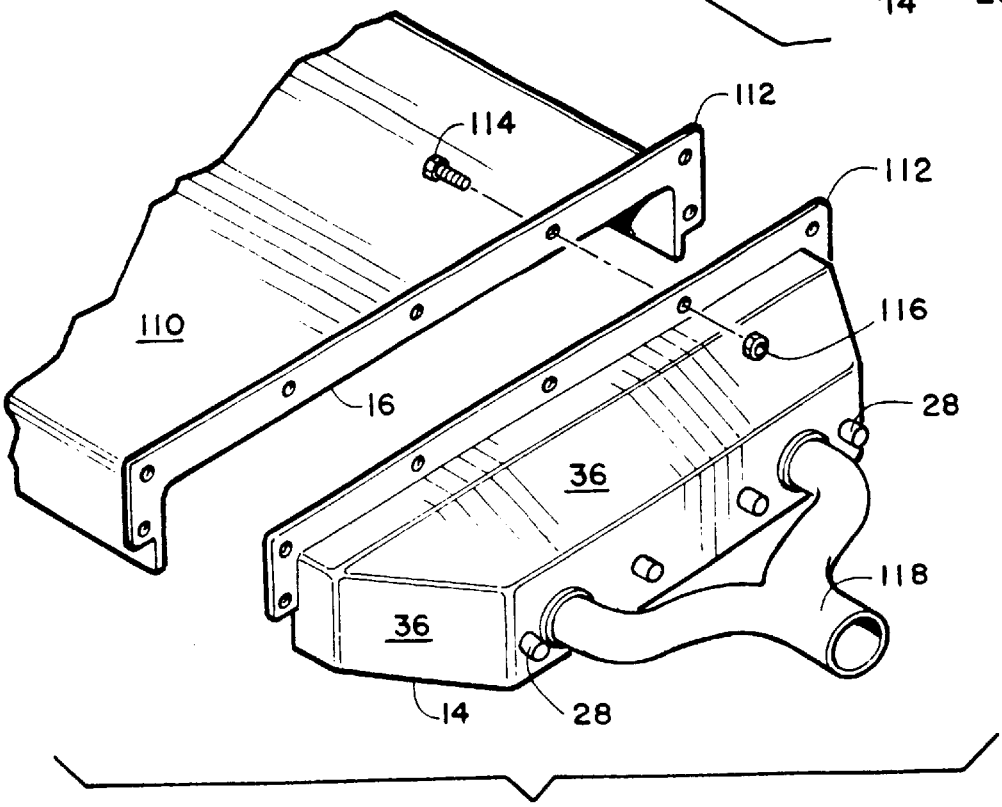
FIG. 7 is a perspective view of a two part, sidewalk mold, incorporating a plurality of input orifices, and a plurality of attachable forms for different shaped concrete extrusions.
Figure 8:
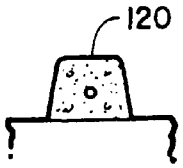
FIG. 8 is a cross sectional view of a typical curb section which is extruded from the device.
Figure 9:
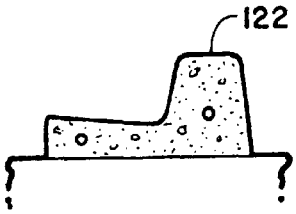
FIG. 9 is a cross sectional view of a typical curb and gutter section.

FIG. 6 and FIG. 7 are perspective views of a multi-segmented, embodiments of the device wherein the device has separable compression chamber 14 from extrusion chamber 16. This embodiment would offer further utility using one or plurality of extrusion chambers 16 that are configured at one end for cooperative sealed engagement with the compression chamber 14. This embodiment would provide users with great utility in that a kit of different shaped extrusion chambers 16 could provide an infinite number of shapes for extruded curbs and sidewalks and barriers as depicted in FIGS. 8–13. In this embodiment, the user would take the appropriately configured extrusion chamber 16, from a kit or collection of extrusion chambers 16 that are configured for cooperative sealed engagement with a compression chamber 14. The extruded are infinite and controlled only by the shape of the extrusion chamber but conventional shapes such as stop blocks, curbs, freeway dividers, and sidewalks are depicted in FIGS. 8–13 for illustrative purposes.

The extrusion chamber 16 and compression chamber 14 would be connected by a means of sealed cooperative engagement such as with flanges 112 held together with number of bolts 114 and nuts 116 as in FIGS. 6 and 7. In this manner the desired extrusion formed by the chosen properly shaped extrusion chamber 16 would be yielded when attached to the compression chamber, that is configured for cooperative engagement therewith. During use, if the user wanted to form a different shape, all that need be done is to dismount the extrusion chamber 16 and from another in the kit of cooperatively engageable extrusion chambers one could be chosen and therein mounted to the compression chamber that is configured to mount to a plurality of such extrusion chambers 16.

Figure 10:
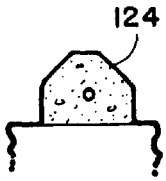
FIG. 10 is a cross sectional view of a stop block section.
Figure 11:
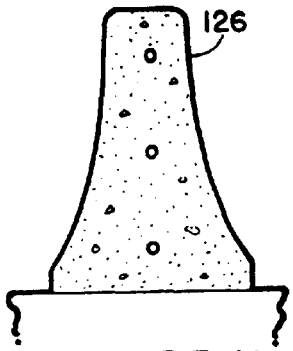
FIG. 11 is a cross sectional view of a barrier section.
Figure 12:
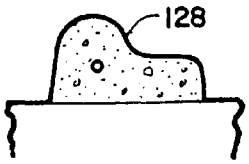
FIG. 12 is a cross sectional view of a decorative edge form.
Figure 13:
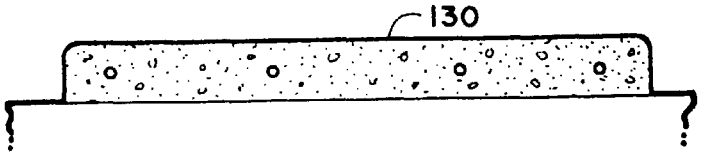
FIG. 13 is a cross section view of a typical sidewalk.
Figure 14:
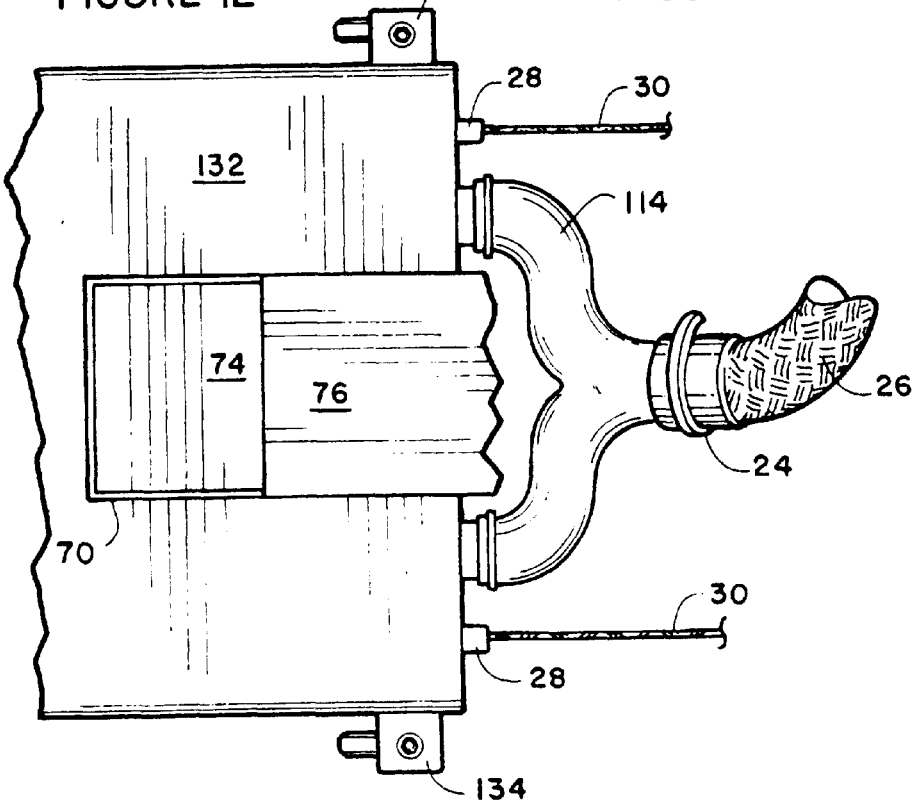
FIG. 14 is a plan view of a sidewalk mold embodiment showing multiple reinforcing bar entry and multiple elevator wheel locations.

FIG. 7 displays an enlarged cavity structure for molding of wide or large volume extrusions such as sidewalks. When a large volume of material is to be extruded in structures such as sidewalks or freeway barriers, the injection of larger volumes of pressurized concrete or cement material is required. The embodiment of FIG. 7 solves this problem by using a manifold style pump hose injection means 118, whereby a plurality of orifices are used to inject the building material into the compression chamber 14. With the enlarged cavities of the compression chamber 14 and extrusion chamber 16, multiple reinforcing bars may also be required and consequently multiple reinforcing bar insertion tubes 28 would allow that the required amount of reinforcing bar 30 be installed into the extruded product, as well as providing a plurality of means to vent gas or air from the device 10 during use. As noted, FIGS. 8–13 display only six of many different styles of mold form shape used in the construction field with the simplest curb form 120 and the curb and gutter combination 122. FIG. 10 shows a typical automobile stop-block configuration 124, which can be constructed on site eliminating the need of transporting stop blocks from a manufacturing site. FIG. 11 shows a barrier system 126 commonly used on freeways, requiring multiple material injection means. FIG. 12 is a commonly used decorative curb mold 128 used on lawns and gardens and FIG. 13 shows the sidewalk configuration 130. FIG. 14 is a plan view of a sidewalk mold 132 with two pivotal, steering and elevating wheels 134. Of course the shapes extruded are only limited by the shape of the extrusion chamber 16 and the requirements of the job at hand and the provision of the ability of multiple shapes from a kit of extrusion chambers 16 may enhance future designs since the disclosed device will allow contractors to easily lay a plurality of shapes with minimal changes to the device 10 and also reduce the qualifications of the users since the device 10 reduces the experience required of the workers to yield properly formed and compacted curb structures.

While all of the fundamental characteristics and features of the cement mold and extruding device and system have been shown and described herein, it should be understood that various substitutions, modifications, and variations may be made by those skilled in the art, without departing from the spirit or scope of the invention. Consequently, all such modifications and variations are included within the scope of the invention as defined by the following claims.

What is claimed is:

1. A molding device for placement of formed cementitious material on a mounting surface for use in combination with a supply of pressurized cementitious material communicated through a hose comprising:

a mold unit, said mold unit defined by a sidewall extending from a top wall, said top wall having an interior surface and an exterior surface, said mold unit having a compression chamber at a first end communicating with an extrusion chamber at a second end, said extrusion chamber having an exit orifice, for the passage of formed material structure therethrough, said exit orifice defined by the termination of said sidewall and said top wall, at said second end;

an intake pipe, said intake pipe having a passage therethrough, said passage in communication with said compression chamber at a discharge aperture, said passage communicating between said compression chamber and an attachment end;

means of sealed attachment of a hose to said attachment end of said intake pipe;

means to vent gas collected from said cementitious material in said compression chamber to the atmosphere; and means of propulsion of said mold unit away from said formed material structure during use whereby said pressurized cementitious material is communicated to said compression chamber and extruded as said formed material through said exit orifice at said extrusion chamber in the shape determined by the shape of said exit orifice.

2. The molding device as defined in claim 1 wherein said intake pipe has a plurality of said discharge apertures communicating with said compression chamber and said passage, each of said plurality of discharge apertures communicating said supply of pressurized cementitious material from said hose attached at said attachment end of said intake pipe.

3. The molding device as defined in claim 1 wherein said means of propulsion of said mold unit away from said formed material is provided by internal pressure of said pressurized cementitious material against said side wall and against said top wall of said mold unit thereby forcing said mold unit away from said formed material being extruded at a determined speed.

4. The molding device as defined in claim 3 further comprising:

means to vary said determined speed of said molding device.

5. The molding device as defined in claim 3 further comprising:

means for controlling upward travel of said mold unit caused by said internal pressure against said top wall.

6. The molding device as defined in claim 5 wherein said means for controlling upward travel of said mold unit caused by said internal pressure against said top wall comprises a variable weighting device comprised of a mounting bracket on the external surface of said top wall, said mounting bracket configured to cooperatively mount one or a plurality of weights.

7. The molding device as defined in claim 6 wherein said means to vary said determined speed of said molding device comprises one or a combination of varying the weight imparted by said variable weighting device and adjusting the pressure of said supply of pressurized cementitious material communicated to said compression chamber.

8. The molding device as defined in claim 1 further comprising an insertion tube communicating through said side wall, said insertion tube having an axial passageway therethrough sized to accommodate the diameter of a reinforcing bar to be inserted into said formed material.

9. The molding device of claim 8 wherein said axial passageway provides said means to vent gas collected from said cementitious material in said compression chamber to the atmosphere.

10. The molding device as defined in claim 1 further comprising means to steer said mold unit.

11. The molding device as defined in claim 10 wherein said means to steer said mold unit comprises:

at least one wheel attached to a wheel mount, said wheel mount communicating with a mounting bracket at a lower end of said mounting bracket, said mounting bracket having a handle on an upper end;

said mounting bracket attached to one end of said mold unit at a steering end of said mold unit; and, said mold unit being steerable by communication of force to said bracket in the direction of desired travel.

12. The molding device as defined in claim 11 further comprising:

means to adjust the height of said mold unit at said steering end.

13. The molding device as defined in claim 12 wherein said means to adjust the height of said mold unit at said steering end comprises:

said handle cooperatively engages threads on said mounting bracket;

said wheel mount being hinged and attached to said mold unit at said steering end; and said wheel mount being rotationally adjusted by engagement of said handle on said mounting bracket to different positions on said mounting bracket.

14. The molding device as defined in claim 12 wherein said means to adjust the height of said mold unit at said steering end comprises:

said mounting bracket having internal cooperative gearing; and said mounting bracket capable of elongation by turning of said handle.

15. The molding device as defined in claim 12 further comprising:

attachment of said mounting bracket to said molding device having cooperating first and second mounts;

said first mount attached to said mounting bracket and said second mount attached to said molding device; and said first mount laterally translatable in said second mount.

16. The molding device as defined in claim 1 further comprising a selectively engageable means to block said formed material from being extruded from said exit orifice.

17. The molding device as defined in claim 1 further comprising:

said compression chamber releasably attachable to said extrusion chamber.

18. The molding device as defined in claim 17 wherein said compression chamber is configured for releasable engagement with any one of a kit having a plurality of different shaped extrusion chambers; and said different shaped extrusion chambers capable of extruding said formed material in different shapes.

19. The molding device as defined claim 1 further comprising a means to guide said molding device along a predetermined path of travel.

20. The molding device as defined in claim 19 wherein said means to guide said molding device along a predetermined path of travel comprises a pair of elongated poles attached to said molding device parallel to each other; and a pair of notches in the distal end of each of said elongated poles, whereby a string may be strung to defined said predetermined path and said molding device may be kept on said predetermined path by maintaining said string inside both of said notches during travel of said molding device.

* * * * *